US009784082B2

(12) United States Patent
Carrizales et al.

(10) Patent No.: US 9,784,082 B2
(45) Date of Patent: Oct. 10, 2017

(54) LATERAL WELLBORE CONFIGURATIONS WITH INTERBEDDED LAYER

(71) Applicant: CONOCOPHILLIPS COMPANY, Houston, TX (US)

(72) Inventors: Maylin A. Carrizales, Houston, TX (US); Wendell P. Menard, Katy, TX (US)

(73) Assignee: ConocoPhillips Company, Houston, TX (US)

( * ) Notice: Subject to any disclaimer, the term of this patent is extended or adjusted under 35 U.S.C. 154(b) by 303 days.

(21) Appl. No.: 13/911,649

(22) Filed: Jun. 6, 2013

(65) Prior Publication Data

US 2013/0333885 A1 Dec. 19, 2013

Related U.S. Application Data

(60) Provisional application No. 61/659,573, filed on Jun. 14, 2012.

(51) Int. Cl.
*E21B 43/30* (2006.01)
*E21B 43/24* (2006.01)

(52) U.S. Cl.
CPC ..... *E21B 43/24* (2013.01); *E21B 43/2406* (2013.01)

(58) Field of Classification Search
CPC ..... E21B 43/24; E21B 43/2406; E21B 43/30; E21B 43/305
See application file for complete search history.

(56) References Cited

U.S. PATENT DOCUMENTS

| | | | |
|---|---|---|---|
| 3,116,792 | A | 1/1964 | Purre |
| 3,692,111 | A | 9/1972 | Breithaupt |
| 4,059,151 | A | 11/1977 | Terry |
| 4,101,172 | A | 7/1978 | Rabbitts |
| 4,151,877 | A | 5/1979 | French |
| 5,016,709 | A | 5/1991 | Combe |
| 5,215,146 | A | 6/1993 | Sanchez |
| 5,377,756 | A | 1/1995 | Northrop |
| 5,417,283 | A | 5/1995 | Ejiogu et al. |
| 5,944,146 | A | 8/1999 | Okpokowuruk |
| 6,016,873 | A | 1/2000 | Hsu et al. |
| 6,158,517 | A | 12/2000 | Hsu |

(Continued)

FOREIGN PATENT DOCUMENTS

EP 2239415 10/2010

*Primary Examiner* — Catherine Loikith
(74) *Attorney, Agent, or Firm* — ConocoPhillips Company

(57) ABSTRACT

Methods and systems relate to recovering hydrocarbons from within formations in which hydrocarbon bearing reservoirs are separated from one another by a fluid flow obstructing natural stratum. Relative to the reservoirs, the stratum inhibits or blocks vertical fluid flow within the formation. Lateral bores divert from lengths of injector and producer wells along where extending in a horizontal direction. These bores pass upward through the formation to intersect the stratum and provide an array of fluid flow paths through the stratum. In a side direction perpendicular to the horizontal direction of the wells, the lateral bores from the injector well pass through the stratum inside of where the lateral bores from the producer well pass through stratum. Fluid communication established by the bores limits counter-current flow through the bores in processes that rely on techniques such as gravity drainage.

20 Claims, 1 Drawing Sheet

(56) References Cited

U.S. PATENT DOCUMENTS

| | | | | |
|---|---|---|---|---|
| 6,199,619 | B1 | 3/2001 | Andersen | |
| 7,073,577 | B2 | 7/2006 | Yu | |
| 7,077,198 | B2 | 7/2006 | Vinegar et al. | |
| 7,128,150 | B2 | 10/2006 | Thomas et al. | |
| 7,404,441 | B2 | 7/2008 | Hocking | |
| 7,441,603 | B2 | 10/2008 | Kaminsky et al. | |
| 8,240,381 | B2 | 8/2012 | Menard et al. | |
| 2005/0161216 | A1 | 7/2005 | Zupanick | |
| 2007/0039729 | A1 | 2/2007 | Watson et al. | |
| 2007/0289736 | A1 | 12/2007 | Ensley et al. | |
| 2008/0164030 | A1 | 7/2008 | Young | |
| 2008/0210423 | A1 | 9/2008 | Boney | |
| 2010/0108317 | A1 | 5/2010 | Cimolai | |
| 2010/0175872 | A1 | 7/2010 | Brown et al. | |
| 2010/0206555 | A1* | 8/2010 | Menard et al. | 166/245 |
| 2011/0015909 | A1 | 1/2011 | Zhou | |
| 2013/0146284 | A1* | 6/2013 | Ayasse | 166/256 |

* cited by examiner

LATERAL WELLBORE CONFIGURATIONS WITH INTERBEDDED LAYER

CROSS-REFERENCE TO RELATED APPLICATIONS

This application is a non-provisional application which claims benefit under 35 USC §119(e) to U.S. Provisional Application Ser. No. 61/659,573 filed Jun. 14, 2012, entitled "Lateral Wellbore Configurations with Interbedded Layer," which is incorporated herein in its entirety.

STATEMENT REGARDING FEDERALLY SPONSORED RESEARCH OR DEVELOPMENT

None

FIELD OF THE INVENTION

Embodiments of the invention relate to methods and systems for recovery of oil, which may be recovered utilizing steam injection into a hydrocarbon-bearing formation.

BACKGROUND OF THE INVENTION

In order to recover oil from certain geologic formations, injection of steam and/or other thermal solvent increases mobility of the oil within the formation via an exemplary process known as steam assisted gravity drainage (SAGD). Production fluid flows from solids that remain in the formation and thus includes the oil and condensate from the steam. Costs associated with such processes require sufficient reservoir thickness to make recovery of the oil economically viable.

However, interbedded layers, such as shale, with limited permeability in the formation act as barriers to vertical flow. These barriers compartmentalize the reservoirs into thin sub-reservoirs that provide a negative impact on economics for development with gravity drainage processes. Vertical wells may contact each thin layer but are not produced at economic rates. Slant wells, multi-horizon wells and multilateral horizontal wells expose more of the reservoir to the wellbore but fail to promote gravity drainage processes.

Therefore, a need exists for improved methods and systems for recovery of oil utilizing gravity drainage based operations.

BRIEF SUMMARY OF THE DISCLOSURE

In one embodiment, a method of producing hydrocarbons includes forming an injection well in a formation and having an injector section that extends lengthwise towards horizontal with laterals extending upward through a stratum having lower permeability than hydrocarbon bearing first and second reservoirs separated by the stratum. The method further includes forming a production well in the formation and having a producer section that extends lengthwise towards horizontal with laterals extending upward through the stratum. Upon introducing fluid into the formation through the injection well, placement of the laterals provides for more of the fluid crossing the stratum through the laterals from the injector section than where the laterals from the producer section pass through the stratum. During producing the hydrocarbons from the first and second reservoirs, the placement of the laterals provides for more of the hydrocarbons crossing the stratum through the laterals from the producer section than where the laterals from the injector section pass through the stratum.

According to one embodiment, a method of producing hydrocarbons includes forming an injection well in a formation and having an injector section that extends in a horizontal direction through a hydrocarbon bearing first reservoir below and separated from a hydrocarbon bearing second reservoir by a stratum having lower permeability than the reservoirs. Further, the method includes forming a production well in the formation and having a producer section extending aligned with the injector section with laterals extending upward from the injector and producer sections to intersect the stratum such that in a side direction perpendicular to the horizontal direction the laterals from the injector section are in an area of the formation bounded by the laterals from the producer section. Introducing steam into the formation through the injection well and into contact with the first reservoir and the second reservoir via the laterals of the injector section facilitates producing the hydrocarbons from the first reservoir and the second reservoir via the laterals of the producer section.

For one embodiment, a method of producing hydrocarbons includes forming an injection well in a formation and having an injector section that extends in a horizontal direction through a hydrocarbon bearing first reservoir below and separated from a hydrocarbon bearing second reservoir by a stratum having lower permeability than the reservoirs and forming a production well in the formation and having a producer section extending aligned with the injector section. Laterals extend upward from the injector and producer sections with the laterals of the injector section each passing through the stratum closer to the injector section relative to where a closest one of the laterals of the producer section passes through the stratum. Introducing steam into the formation through the injection well and into contact with the first reservoir and the second reservoir via the laterals of the injector section facilitates producing the hydrocarbons from the first reservoir and the second reservoir via the laterals of the producer section.

BRIEF DESCRIPTION OF THE DRAWINGS

A more complete understanding of the present invention and benefits thereof may be acquired by referring to the following description taken in conjunction with the accompanying drawings.

DETAILED DESCRIPTION

Embodiments relate to methods and systems for recovering hydrocarbons from within formations in which hydrocarbon bearing reservoirs are separated from one another by a fluid flow obstructing natural stratum. Relative to the reservoirs, the stratum inhibits or blocks vertical fluid flow within the formation. Lateral bores divert from lengths of injector and producer wells along where extending in a horizontal direction. These bores pass upward through the formation to intersect the stratum and provide an array of fluid flow paths through the stratum. In a side direction perpendicular to the horizontal direction of the wells, the lateral bores from the injector well pass through the stratum inside of where the lateral bores from the producer well pass through stratum. Fluid communication established by the bores limits counter-current flow through the bores in processes that rely on techniques such as gravity drainage.

The stratum defines a layer with lower permeability to fluid flow than the reservoirs. For some embodiments, layers of shale form the stratum. The stratum initially obstructs or prevents fluid communication between the reservoirs and may be impermeable in a natural state to flow of fluids such as the hydrocarbons or steam.

Figure 1:
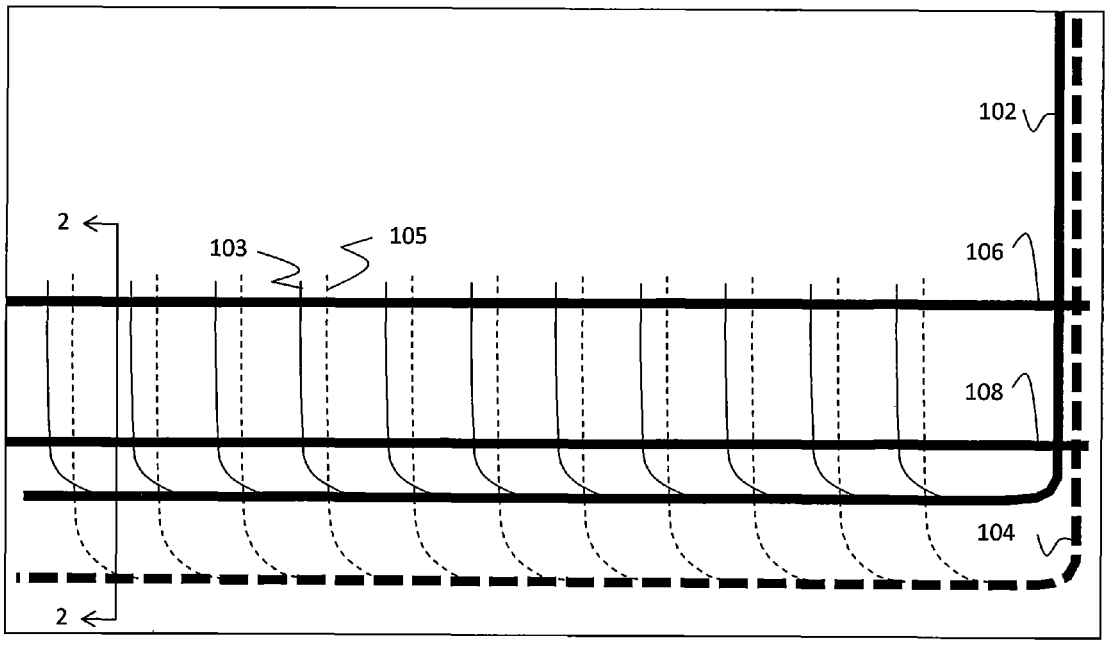
FIG. 1 is a schematic of a formation with an injector and producer drilled with each having multilateral boreholes penetrating through a limited permeability layer of the formation, according to one embodiment of the invention.

FIG. 1 shows an injector well 102 and a producer well 104 traversing through an earth formation containing petroleum products, such as heavy oil or bitumen that may have an initial API gravity less than 25°, less than 20°, or less than 10°. In operation, a thermal fluid, such as steam and/or solvent, supplied through the injector well 102 makes the products mobile enough to enable or facilitate recovery with the producer well 104. For some embodiments, the injector well 102 includes a horizontal length that is disposed above (e.g., 0-6 meters above) and parallel to a horizontal length of the producer well 104.

As used herein, the solvent refers to a fluid that can dilute the heavy oil and/or bitumen. Examples of the solvent include gases, such as $CO_2$ or CO, C1 to C30 hydrocarbons including alkanes such as methane, ethane, propane, butane, pentane, hexane, heptane, octane, nonane, decane, aromatics such as toluene and xylene, as well as various available hydrocarbon fractions, such as condensate, gasoline, naphtha, diluent and combinations thereof. Some embodiments utilize condensing solvents or solvents that are liquid under reservoir conditions.

For some embodiments, the injector and producer wells 102, 104 pass through at least one stratum, such as a first layer 106 and a second layer 108, which obstructs or prevents fluid communication between reservoirs separated by the layers 106, 108. An interior of the injector and producer wells 102, 104 where extending in a vertical direction to surface may lack direct fluid communication with the reservoirs due to being cased with solid wall tubing. The horizontal lengths of the injector and producer wells 102, 104 pass in a horizontal direction below the second layer 108.

Some embodiments may produce form two, three or more different stratified regions even though three are shown by example herein. In particular, areas above the first 106, between the first and second layers 106, 108 and below the second layer 108 form three distinct reservoirs. One or more of the reservoirs may define a vertical thickness of less than 5.0 meters (m), less than 10 m, or less than 20 m.

The injector and producer wells 102, 104 further include respective upward injection laterals 103 and upward production laterals 105. As shown, the laterals 103, 105 extend from the horizontal lengths of the injector and producer wells 102, 104 in an upward direction. The laterals 103, 105 thereby intersect the layers 106, 108.

Figure 2:
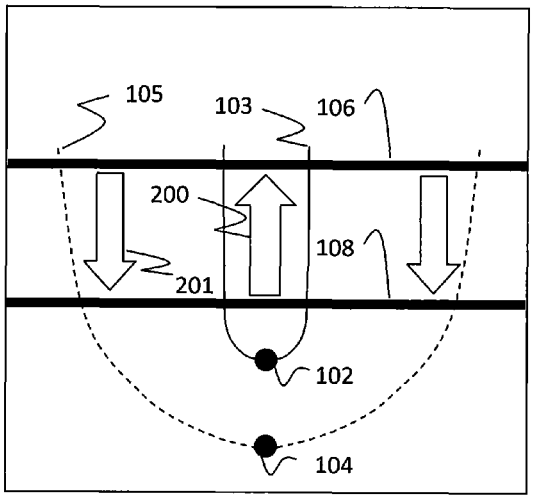
FIG. 2 is a schematic of the formation taken across line 2-2 of FIG. 1, according to one embodiment of the invention.

FIG. 2 illustrates the wells 102, 104 and laterals 103, 105 in the formation as viewed across line 2-2 in FIG. 1, which cross-section is a vertical plane perpendicular to the horizontal direction that the wells 102, 104 extend. Starting from the injector well 102, the injection laterals 103 extend up and are drilled through the layers 106, 108 closer to the injector well 102 relative to where the production laterals 105 that are closest pass through the layers 106, 108. The production laterals 105 thus extend further away from the producer well 104 before intersecting the layers 106, 108 than the injection laterals 103 extend from the injector well 102 before intersecting the layers 106, 108.

In this side direction perpendicular to the horizontal length of the wells 102, 104, the injection laterals 103 pass through the layers 106, 108 inside of where the production laterals pass through layers 106, 108. The injection laterals 103 may thus form a narrow U-shape or V-shape within a wider U-shape of V-shape formed by the production laterals 105. While the laterals 103, 105 may extend on both sides of the injector and producer wells 102, 104 to form such shapes, the laterals 103, 105 extending on one side of the wells 102, 104 may align at common locations with the laterals 103, 105 extending on the other side of the wells 102, 104 or be staggered.

Further, the production laterals 105 may extend from the producer well 104 at a common distance in the horizontal direction as where the injection laterals 103 extend from the injector well 102 or be staggered to maximize separation between the injection laterals 103 and the production laterals 105. In some embodiments, the laterals 103, 105 may extend from a single side of the wells 102, 104. For some embodiments, the injection laterals 103 may all extend upward in vertical alignment with the injector and producer wells 102, 104 (i.e., not to either side of the injector well 102) while the production laterals 105 may extend upwards and to each side of the producer well 104.

While additional wells or multiple horizontal bores may increase costs, some embodiments may achieve similar intersections through the layers 106, 108 as described herein with production laterals 105 that extend from more than one producer well 104 or separate horizontal bores disposed on each side of the injector well 102. Configurations may likewise employ more than one injector well 102 from which the injection laterals 103 extend. Principles of operation do not change with such additional wells or horizontal bores that still provide the injection laterals 103 in a position relative the production laterals 105 as otherwise described herein.

The laterals 103, 105 provide fluid flow paths across the layers 106, 108. Further, this configuration allows steam to flow up (depicted by arrow 200) the injection laterals 103 and products to drain down (depicted by arrow 201) the production laterals 105. Separated placement of the laterals 103, 105 through the layers 106, 108 facilitates in at least reducing counter-current flow through each of the laterals 103, 105 in order to improve performance.

In operation, the steam 200 introduced into the injector well 102 exits the injector well 102 through the horizontal length and/or the injection laterals 103. The injector well 102 couples to a steam source or steam generator that supplies the steam 200. Slotted or perforated liner wall sections or open-hole enable outflow of the steam 200 along the horizontal length and/or the injection laterals 103. The steam 200 passes through the reservoir and the fluid flow paths created by the injection laterals 103 to heat and mix with the hydrocarbons in all three of the reservoirs.

The producer well 104 gathers the products 201 including the hydrocarbons drained from the reservoirs upon the hydrocarbons being drained through the flow paths created by the production laterals 105. The horizontal length of the producer well 104 and/or the production laterals 105 include slotted or perforated liner wall sections or are open-hole to enable inflow of the hydrocarbons. Relative to permeability of the reservoir, the laterals 103, 105 create a streak of high permeability to facilitate such gravity drainage processes.

For some embodiments, a packing material fills one or more of the laterals 103, 105. The packing material maintains permeability through the layers 106, 108 and may be disposed in passageways formed where the laterals 103, 105 traverse the stratum without completely filling each of the laterals 103, 105. Examples of the packing material include sand, gravel pack, or granular proppant supplied through the wells 102, 104 from surface. Filling the passageways ensures control of permeability across the layers 106, 108 since the laterals 103, 105 may tend to collapse resulting in lower permeability characteristics than desired. Any drilled bores through stratums to establish flow paths as described herein may include the packing material or be left open-hole.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A method of producing hydrocarbons, comprising:

forming an injection well in a formation and having an injector section that extends lengthwise towards horizontal with open-hole injection laterals extending upward from said injector section through a stratum having lower permeability than hydrocarbon bearing first and second reservoirs separated by the stratum;

forming a production well in the formation and having a producer section that extends lengthwise towards horizontal with open-hole production laterals extending upward from said producer section through the stratum;

introducing fluid into the formation through the injection well, wherein placement of the injection and production laterals provides for more steam fluid crossing the stratum through the injection laterals from the injector section than where the production laterals from the producer section pass through the stratum; and producing the hydrocarbons from the first and second reservoirs, wherein the placement of the injection and production laterals provides for more of the hydrocarbons crossing the stratum through the production laterals from the producer section than where the injection laterals from the injector section pass through the stratum, wherein injection and production laterals on the injection well and the production well, respectively, limit countercurrent flow through the injection and production laterals.

2. The method according to claim 1, wherein the fluid is at least one of steam and a solvent for the hydrocarbons.

3. The method according to claim 1, further comprising filling at least some of the injection and production laterals with a particulate material.

4. The method according to claim 1, wherein the production and injection laterals extend from the producer and injector sections to form one of a U-shape and a V-shape.

5. The method according to claim 1, wherein the production and injection laterals extend from the producer and injector sections in a configuration that forms one of a U and V with the configuration of the producer section being wider than the configuration of the injector section.

6. The method according to claim 1, wherein the injection laterals from the injector section are in an area of the formation bounded in a side direction perpendicular to a length of the sections by the production laterals from the producer section.

7. The method according to claim 1, wherein the injection laterals of the injector section each pass through the stratum closer to the injector section relative to where a closest one of the production laterals of the producer section passes through the stratum.

8. The method according to claim 1, wherein the producer section is disposed parallel and in vertical alignment below the injector section.

9. The method according to claim 1, wherein the injection and production laterals are dispersed along lengths of the injector and producer sections.

10. The method according to claim 1, wherein the production laterals extend from the producer section at staggered locations along a length of the producer section relative to where the injection laterals extend from the injector section to maximize separation between the injection laterals from the injector section and the production laterals from the producer section.

11. The method according to claim 1, wherein the injection and production laterals extend from both sides of each of the injector and producer sections such that the laterals on one side are aligned at common locations with the laterals extending on an opposite side.

12. A method of producing hydrocarbons, comprising:

forming an injection well in a formation and having an injector section that extends in a horizontal direction through a hydrocarbon bearing first reservoir below and separated from a hydrocarbon bearing second reservoir by a stratum having lower permeability than the reservoirs;

forming a production well in the formation and having a producer section extending aligned with the injector section, wherein open-hole laterals extend upward from the injector and producer sections to intersect the stratum such that in a side direction perpendicular to the horizontal direction the laterals from the injector section are in an area of the formation bounded by the laterals from the producer section;

introducing steam into the formation through the injection well and into contact with the first reservoir and the second reservoir via the laterals of the injector section; and producing the hydrocarbons from the first reservoir and the second reservoir via the laterals of the producer section, wherein laterals on both the injection well and the production well limit counter-current flow through the laterals.

13. The method according to claim 12, further comprising filling at least some of the laterals with a particulate material.

14. The method according to claim 12, wherein the laterals extend from the producer and injector sections to form one of a U-shape and a V-shape.

15. The method according to claim 12, wherein the laterals extend from the producer and injector sections in a configuration that forms one of a U and V with the configuration of the producer section being wider than the configuration of the injector section.

16. The method according to claim 12, further comprising injecting a solvent for the hydrocarbons with the steam.

17. A method of producing hydrocarbons, comprising:

forming an injection well in a formation and having an injector section that extends in a horizontal direction through a hydrocarbon bearing first reservoir below and separated from a hydrocarbon bearing second reservoir by a stratum having lower permeability than the reservoirs;

forming a production well in the formation and having a producer section extending aligned with the injector section, wherein open-hole laterals extend upward from the injector and producer sections with the laterals of the injector section each passing through the stratum closer to the injector section relative to where a closest one of the laterals of the producer section passes through the stratum;

introducing steam into the formation through the injection well and into contact with the first reservoir and the second reservoir via the laterals of the injector section; and producing the hydrocarbons from the first reservoir and the second reservoir via the laterals of the producer section, wherein laterals on both the injection well and the production well limit counter-current flow through the laterals.

18. The method according to claim 17, further comprising filling at least some of the laterals with a particulate material.

19. The method according to claim 17, wherein the laterals extend from the producer and injector sections to form one of a U-shape and a V-shape.

20. The method according to claim 17, wherein the laterals extend from the producer and injector sections in a configuration that forms one of a U and V with the configuration of the producer section being wider than the configuration of the injector section.

* * * * *